United States Patent [19]

Miller et al.

[11] Patent Number: 4,569,663

[45] Date of Patent: Feb. 11, 1986

[54] STEERING CONTROL FOR TROLLING MOTOR

[76] Inventors: Darrell G. Miller, 210 Parkway, Irving, Tex. 75061; Presley W. Miller, 3010 Harvard, Irving, Tex. 75062

[21] Appl. No.: 570,193

[22] Filed: Jan. 12, 1984

[51] Int. Cl.[4] ..... B63H 21/26

[52] U.S. Cl. ..... 440/7; 114/153; 440/63; 74/512

[58] Field of Search ..... 440/6, 7, 53, 63; 114/144 R, 153; 74/480 B, 512

[56] References Cited

U.S. PATENT DOCUMENTS

| | | | |
|---|---|---|---|
| 2,332,122 | 10/1943 | Vaughn . | |
| 2,600,767 | 6/1952 | Herrell . | |
| 2,753,709 | 7/1956 | Beck | 74/512 |
| 2,804,838 | 9/1957 | Moser . | |
| 2,829,616 | 4/1958 | O'Brien et al. . | |
| 2,968,273 | 1/1961 | Corbett et al. . | |
| 3,002,398 | 10/1961 | Beamer . | |
| 3,073,278 | 1/1963 | Brewster | 74/480 B |
| 3,241,394 | 3/1966 | Rubenstein . | |
| 3,288,099 | 11/1966 | Bittner . | |
| 3,316,773 | 5/1967 | Findlay . | |
| 3,587,512 | 6/1971 | Patterson . | |
| 3,606,858 | 9/1971 | Edwards et al. . | |
| 3,722,314 | 3/1973 | Sorenson et al. | 74/512 |
| 3,807,345 | 4/1974 | Peterson . | |
| 4,125,032 | 11/1978 | Shuler . | |
| 4,273,211 | 6/1981 | Sarmiento . | |
| 4,386,918 | 6/1983 | Matthews et al. . | |

*Primary Examiner*—Trygve M. Blix
*Assistant Examiner*—Stephen P. Avila
*Attorney, Agent, or Firm*—Richards, Harris, Medlock & Andrews

[57] ABSTRACT

A steering control (10) is foot operated to provide directional control for a trolling motor (72). The control (10) is mounted by a plate (18) to a boat (74). A foot pedal (12) is pivotally supported by a member (16) which is connected to a plate (18). An electrical switch (28) is mounted on the toe portion of the foot pedal (12). A guide rod (32) is mounted at one end to an upright member (20) which is mounted on the toe end of the foot pedal (12). The second end of the guide rod (32) is connected to one end of a bracket (50). The opposite end of the bracket (50) is clamped to a vertical shaft (70) of the trolling motor (72). When an operator causes the foot pedal to pivot, the rod (32) is moved longitudinally to move the bracket (50) and thereby cause the shaft (70) to pivot thus providing steering control for the trolling motor (72).

1 Claim, 4 Drawing Figures

FIG. 3
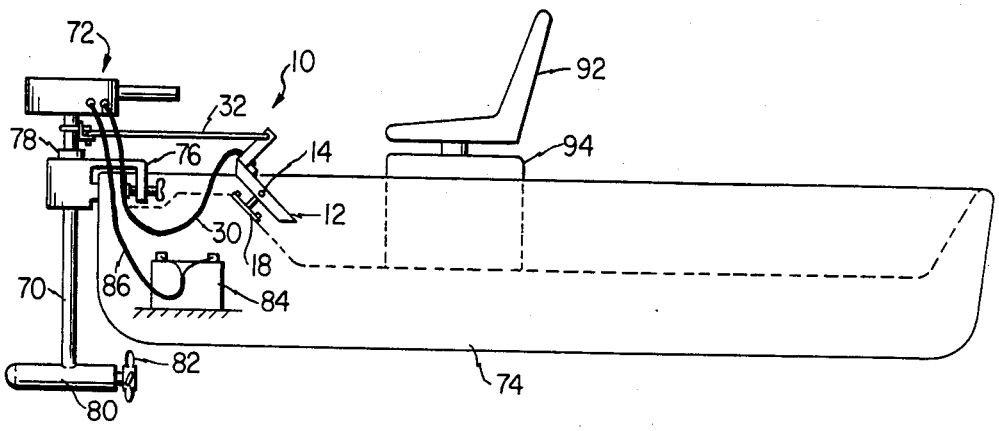
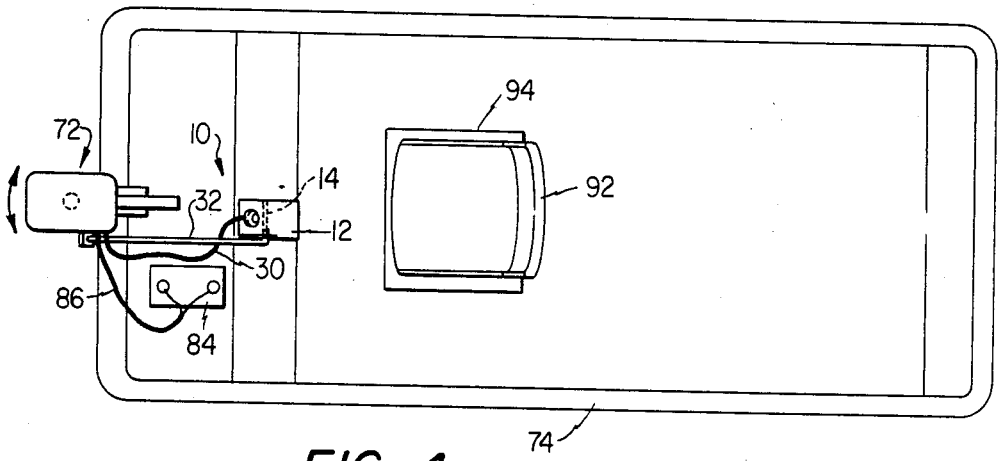
FIG. 4

STEERING CONTROL FOR TROLLING MOTOR

TECHNICAL FIELD

The present invention pertains to mechanical steering apparatus and in particular to such apparatus for steering a trolling motor by foot control.

BACKGROUND OF THE INVENTION

Fishermen frequently use small electric outboard motors, termed trolling motors, to maneuver a boat while fishing. Since the activities in fishing often require the use of both hands there have been developed various types of apparatus for guiding a trolling motor by foot operation. Such controls are shown, for example, in U.S. Pat. Nos. 2,829,616; 2,804,838; 3,002,398 and 2,968,273.

Although numerous types of steering apparatus have been developed, there still remain problems with the use of such devices. Many steering control devices use a flexible cable within a sheath, but this type of cable is expensive, bulky, inconvenient, often requires adjustment, and can become difficult to work due to friction within the sheath. Other types of devices have complex mechanical linkage which is expensive and prone to failure.

Therefore, there exists a need for an inexpensive, simple, reliable and easy to operate foot control steering mechanism for a trolling motor, particularly for use in a light-weight fishing boat.

SUMMARY OF THE INVENTION

A selected embodiment of the present invention comprises a steering control for an outboard trolling motor which is mounted on a boat and is directionally controlled by pivoting about a vertical shaft. The steering control includes a plate which is mounted to the boat together with a support member that is rigidly mounted to the plate. A foot pedal is pivotally mounted to the upper end of the support member. An upright member is rigidly mounted to one end of the foot pedal. A guide rod has a first end pivotally connected to the upright member. A bracket is attached to the vertical shaft of the trolling motor and includes a portion thereof which extends transversely outward from the shaft. The second end of the guide rod is pivotally connected to the bracket wherein movement of the foot pedal about its pivot causes the guide rod to move longitudinally. The movement of the guide rod causes the vertical shaft of the trolling motor to rotate about its axis thereby steering the trolling motor by operation of the foot pedal.

BRIEF DESCRIPTION OF THE DRAWINGS

For a more complete understanding of the present invention and the advantages thereof, reference is now made to the following description taken in conjunction with the accompanying drawings in which:

FIG. 3 is an elevation view showing the installation of the steering control apparatus of the present invention on a boat which has a trolling motor mounted thereon; and FIG. 4 is a plan view of the boat and installation shown in FIG. 3 for illustrating the pivoting action of the trolling motor in response to operation of the foot pedal.

DETAILED DESCRIPTION OF THE INVENTION

Figures 1, 2:
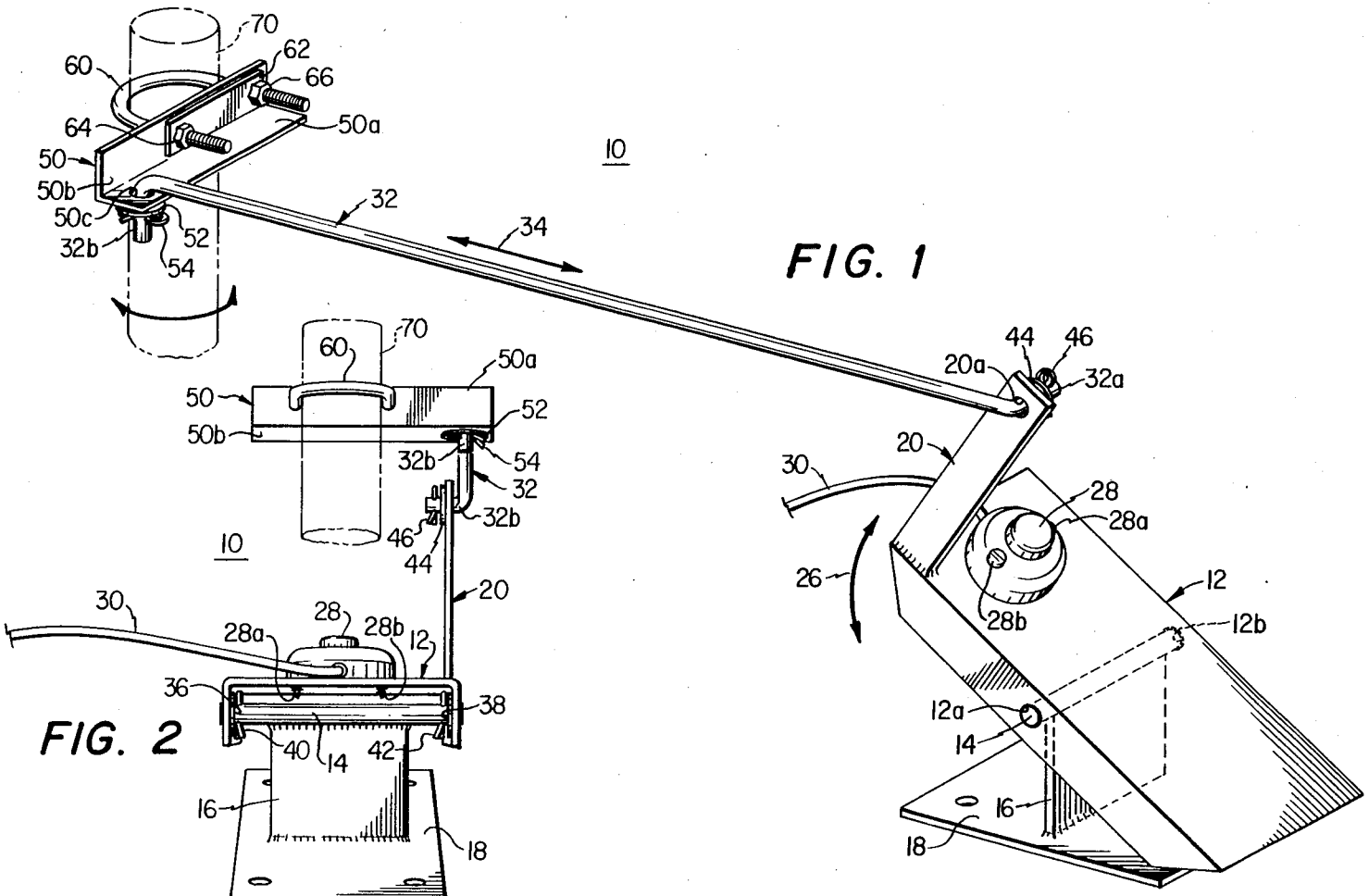
FIG. 1 is a perspective view of the steering control apparatus of the present invention showing the upper surface of the foot pedal.
FIG. 2 is a perspective view showing the steering control of the present invention from a front, lower view.

The mechanical structure of the steering control apparatus of the present invention is illustrated in FIGS. 1 and 2. The installation and operation of the steering control apparatus in a boat is shown in FIGS. 3 and 4. Referring now to FIGS. 1 and 2, the steering control 10 includes a foot pedal 12 which has a U-shaped cross section. The opposite sides of the pedal 12 have holes 12*a* and 12*b* which receive a rod 14. A support member 16 has the rod 14 welded to the upper end thereof. A plate 18 has the support member 16 welded thereto. The support member 16 is mountwed at a 90° angle to the plate 18.

An upright member 20 is rigidly mounted to the toe end of the foot pedal 12 at the left side thereof. The member 20 is provided with a hole 20*a* at the upper end thereof.

The foot pedal 12 pivots about the rod 14 in response to heel and toe pressure applied by an operator. The foot pedal pivots about the rod 14 as indicated by the arrow 26.

An electrical switch 28 is mounted on the toe end of the foot pedal 12 with screws 28*a* and 28*b*. The switch 28 is connected through a cable 30 to control the on/off state of a trolling motor, described below.

A guide rod 32 has a 90° section 32*a* at a first end thereof which extends through the hole 20*a*. The guide rod 32 also has a 90° section 32*b* at the second end thereof. The axes of the sections 32*a* and 32*b* are at right angles to each other. When the foot pedal 12 is pivoted about the rod 14, as indicated by arrow 26, the guide rod 32 is longitudinally moved as indicated by an arrow 34.

The foot pedal 12 is held in place on the rod 14 by washers 36 and 38 which are themselves held in place by cotter pins 40 and 42. The guide rod 32 is secured in the hole 20*a* by a washer 44 and a cotter pin 46. The section 32*b* of the guide rod 32 is pivotally mounted to an angle bracket 50 having perpendicular sections 50*a* and 50*b*. The section 50*a* includes a hole 50*c* which receives the section 32*b*. A washer 52 and cotter pin 54 are mounted on the section 32*b* to secure the guide rod 32 to the bracket 50.

A U-bolt 60 is positioned through two holes at one end of the angle bracket section 50*b*. The U-bolt 60 extends through a plate 62 and is secured by nuts 64 and 66. The U-bolt 60, in operation, is clamped to a vertical shaft 70 which is the shaft of a trolling motor.

The installation and operation of the steering control 10 is now described in reference to FIGS. 3 and 4. The control 10 is mounted on an interior surface of the boat 74 by bolts secured to the plate 18. An electric trolling motor 72 is mounted on the transom of the boat 74 by clamp assembly 76. The vertical shaft 70 of the motor 72 extends downward through the clamp assembly 76 and is supported on the assembly 76 by collar 78. At the lower end of the shaft 70 there is a motor 80 which drives a propeller 82.

The motor 80 is powered by a battery 84 which is connected to the motor 80 by a cable 86.

The steering control operator, typically a fisherman, sits in a seat 92 which is supported by a pedestal 94 that is in turn mounted to the boat 74. While the operator sits in the seat 92, he places one foot on the foot pedal 12 for activating and steering the motor 72. The operator depresses the switch 28 whenever he wishes to turn on the motor 72. When the operator has depressed the switch 28 and applied toe pressure to move the guide rod 32 away from him, the motor 72 is caused to rotate clockwise, as viewed from above. But when the operator applies heel pressure on the pedal 12, the guide rod 32 is pulled toward him thereby causing the trolling motor 72 to rotate counterclockwise about the axes of the vertical shaft 70. The boat 74 is typically traveling forward so that when the operator applies toe pressure to the pedal 12 he steers the boat to the right and when he applies heel pressure to the pedal 12, he steers the boat to the left. Thus, at all times the operator has free use of both hands.

In summary, the present invention comprises a simple, reliable apparatus for direct linkage control from a foot pedal to a trolling motor. By foot operation alone the operator can turn the trolling motor on or off and at the same time apply the desired steering control.

Although one embodiment of the invention has been illustrated in the accompanying drawings and described in the foregoing Detailed Description, it will be understood that the invention is not limited to the embodiment disclosed, but is capable of numerous rearrangements, modifications and substitutions of parts and elements without departing from the scope of the invention.

What I claim is:

1. A steering control for attachment to an outboard trolling motor which is mounted on a boat and is directionally controlled by pivoting on a vertical shaft, comprising:

a plate for mounting to said boat;

a support member rigidly connected to said plate and including a rod connected to the upper end of said support member;

a foot pedal having a U-shaped cross section with holes in opposite sides to receive said rod wherein said foot pedal pivots about said rod;

an upright member rigidly connected to the toe end of said foot pedal;

a guide rod having a first end thereof pivotally connected to the upper end of said upright member;

a U-bolt;

a bracket attached to said shaft by means of said U-bolt and extending transversely outward from said shaft, said guide rod having a second end thereof pivotally connected to said bracket wherein pivotal movement of said foot pedal causes longitudinal translation of said guide bar which in turn causes said vertical shaft to rotate thereby steering said trolling motor; and a foot-operated switch mounted to extend above the upper surface of said foot pedal and connected by a cable to said trolling motor for selectively activating said trolling motor by operation of said switch.

* * * * *